US011103874B2

(12) United States Patent
Sjoberg

(10) Patent No.: US 11,103,874 B2
(45) **Date of Patent: *Aug. 31, 2021**

(54) GYRATORY CRUSHER HYDRAULIC PRESSURE RELIEF VALVE

(71) Applicant: SANDVIK INTELLECTUAL PROPERTY AB, Sandviken (SE)

(72) Inventor: Patrik Sjoberg, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 16/655,536

(22) Filed: Oct. 17, 2019

(65) Prior Publication Data

US 2020/0047185 A1 Feb. 13, 2020

Related U.S. Application Data

(62) Division of application No. 14/772,866, filed as application No. PCT/EP2014/051510 on Jan. 27, 2014, now Pat. No. 10,478,823.

(30) Foreign Application Priority Data

Mar. 7, 2013 (EP) ..... 13158175

(51) Int. Cl.
*B02C 2/04* (2006.01)
*B02C 2/02* (2006.01)
*B02C 23/04* (2006.01)

(52) U.S. Cl.
CPC ..... *B02C 2/047* (2013.01); *B02C 2/02* (2013.01); *B02C 2/04* (2013.01); *B02C 23/04* (2013.01)

(58) Field of Classification Search
CPC .. B02C 2/047; B02C 2/02; B02C 2/04; B02C 23/04
USPC ..... 241/30; 137/488, 514.3, 504, 15.21
See application file for complete search history.

(56) References Cited

U.S. PATENT DOCUMENTS 3,133,706 A * 5/1964 Mertz ..... B02C 2/06 241/32
3,797,760 A * 3/1974 Davis ..... B02C 2/045 241/30
4,060,205 A * 11/1977 Pollak ..... B02C 2/047 241/211
4,147,309 A * 4/1979 Vroom ..... B02C 25/00 241/215
7,883,042 B2 * 2/2011 Torres ..... B02C 2/047 241/207

(Continued)

*Primary Examiner* — Shelley M Self
*Assistant Examiner* — Smith Oberto Bapthelus
(74) *Attorney, Agent, or Firm* — Corinne R. Gorski

(57) ABSTRACT

A gyratory crusher hydraulic pressure relief valve includes a hydraulic fluid vestibule arranged to be fluidly connected to a hydraulic fluid space. A logic element is arranged to dump hydraulic fluid from the hydraulic fluid space, which includes a plunger having a first plunger surface and a second plunger surface, and a control pipe arranged for fluidly connecting the second plunger surface to the hydraulic fluid vestibule. A supply orifice restricts the flow of hydraulic fluid from the vestibule towards the second plunger surface to make the time TC it takes for the logic element to switch from open position to closed position exceed the time TF it takes for a closed side setting position of the crusher to make one full round.

10 Claims, 5 Drawing Sheets

(56) References Cited

U.S. PATENT DOCUMENTS

| | | | | |
|---|---|---|---|---|
| 2009/0256013 | A1* | 10/2009 | Eriksson | B02C 25/00 241/15 |
| 2009/0256015 | A1* | 10/2009 | Torres | B02C 2/047 241/30 |
| 2013/0001337 | A1* | 1/2013 | Sjoberg | B02C 2/047 241/27 |
| 2020/0047185 | A1* | 2/2020 | Sjoberg | B02C 2/04 |

* cited by examiner

II-II

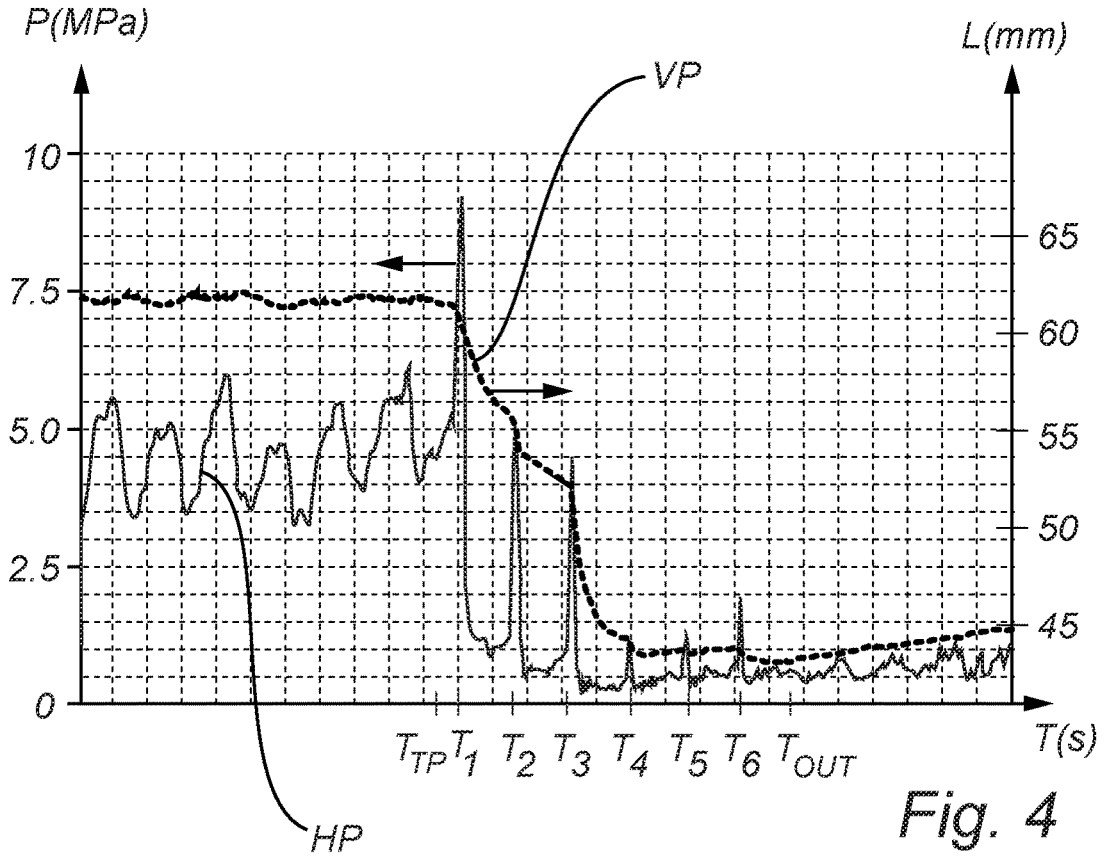
Fig. 4
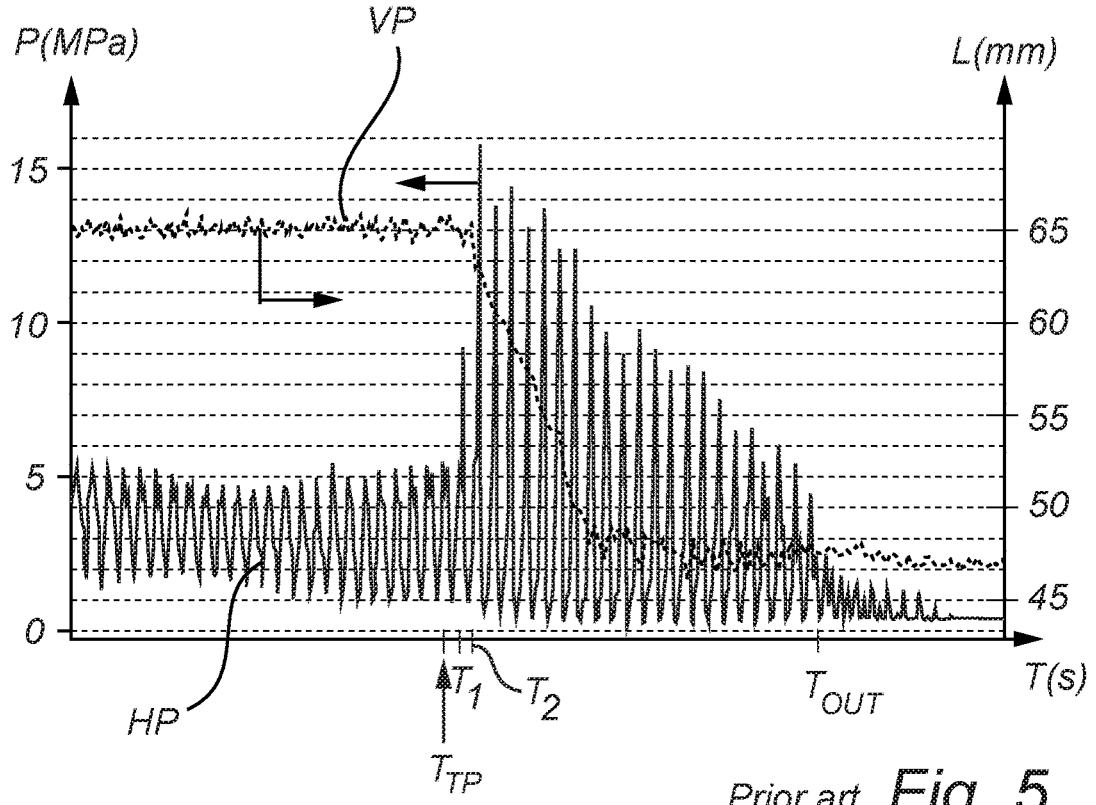
Prior art Fig. 5

GYRATORY CRUSHER HYDRAULIC PRESSURE RELIEF VALVE

RELATED APPLICATION DATA

This application is a divisional of U.S. patent application Ser. No. 14/772,866 filed Sep. 4, 2015, which is a § 371 National Stage Application of PCT International Application No. PCT/EP2014/051510 filed Jan. 27, 2014 claiming priority of EP Application No. 13158175.3, filed Mar. 7, 2013.

TECHNICAL FIELD

The present disclosure relates to a gyratory crusher hydraulic pressure relief valve including a hydraulic fluid vestibule, which is arranged to be fluidly connected to a hydraulic fluid space of a gyratory crusher, and a logic element, which is arranged to dump hydraulic fluid from the hydraulic fluid space and which includes a plunger. The present disclosure further relates to a method of controlling the hydraulic pressure in a gyratory crusher hydraulic system.

BACKGROUND

Gyratory crushers, sometimes called cone crushers, are utilized in many applications for crushing hard material, such as pieces of rock, ore etc. In a gyratory crusher, a crushing gap is formed between an outer crushing shell and an inner crushing shell. The inner crushing shell is mounted on a crushing head, which is made to gyrate by means of an eccentric. The vertical position of the inner crushing shell relative to the position of the outer crushing shell, and, hence, the width of the crushing gap, may be controlled by a hydraulic control system. As the crushing head is gyrated pieces of rock etc., is crushed between the inner and outer crushing shells in the crushing gap.

Occasionally objects that are not easy to crush enter the crushing gap. Such objects, sometimes referred to as tramp material, may cause severe damage to a gyratory crusher. U.S. Pat. No. 4,060,205 discloses a hydraulic accumulator, which relieves the pressure in a hydraulic control system when uncrushable objects enter the crushing gap. It has been found, however, that also with the hydraulic accumulator of U.S. Pat. No. 4,060,205, the gyratory crusher may be exposed to very high pressure peaks when uncrushable objects enter the crushing gap.

SUMMARY

It is an object of the present disclosure to provide a method of handling uncrushable objects entering the crushing gap of a gyratory crusher in such manner that the mechanical stresses to which the crusher is exposed are reduced.

This object is achieved by a method of controlling the hydraulic pressure in a gyratory crusher hydraulic system, the hydraulic system including a pressure relief valve that has a hydraulic fluid vestibule, which is fluidly connected to a hydraulic fluid space of a gyratory crusher, a logic element for dumping hydraulic fluid from the hydraulic fluid space and which includes a plunger that has a first plunger surface, which is fluidly connected to the hydraulic fluid in the hydraulic fluid vestibule, and a second plunger surface, which is arranged opposite to the first plunger surface, and at least a first control pipe which fluidly connects the second plunger surface to the hydraulic fluid vestibule. The method includes restricting the flow of hydraulic fluid from the hydraulic fluid vestibule to the second plunger surface to make the time TC it takes for the logic element to switch from an open position to a closed position exceed the time (TF) it takes for a closed side setting (CSS) position of the gyratory crusher to make one full round.

An advantage of this method is that the logic element will remain at least partly open after a first pressure peak has been generated by an uncrushable object, such as a piece of tramp material, being squeezed at a (CSS) position, such that dumping of hydraulic fluid from the hydraulic fluid space the next time that same piece of tramp material is squeezed at the (CSS) position starts quickly, since the logic element is already at least partly open. Thereby, the mechanical stresses on the hydraulic system, on the crushing shells, shaft, etc., are reduced. Furthermore, the fact that the logic element remains open also increases the width of the crushing gap, such that the piece of tramp material passes through the crushing gap quicker, and is squeezed fewer times at the (CSS) position. Thus, the gyratory crusher system is exposed to very small mechanical stresses, which prolongs the service life of the crusher system and/or makes it possible to design the crusher system with smaller safety margins to pressure peaks.

The term "open position" with regard to the plunger of the logic element includes also situations where the plunger of the logic element is partially open. In some instances, for example with a moderately sized uncrushable object, or with a relatively large logic element, a partial opening of the plunger of the logic element may be sufficient for handling the pressure peak. Hence, the time (TC) it takes for the logic element to switch from an open position to a closed position exceeds, for at least some degrees of opening of the plunger, the time (TF) it takes for a closed side setting (CSS) position of the gyratory crusher to make one full round. According to one embodiment, the time (TC) exceeds the time (TF) when the open position of the logic element corresponds to a degree of opening of the plunger, with respect to the stroke of the plunger, which is somewhere in the range of 25-100%.

According to one embodiment, the method further includes restricting the flow of hydraulic fluid from the vestibule to the second plunger surface to make the time (TC) it takes for the logic element to switch from an open position to a closed position at least 1.2 times larger than the time (TF) it takes for a closed side setting (CSS) position of the crusher to make one full round. More preferably the relation between the times (TC) and (TF) fulfil the requirement of $1.5*TF<TC<10*TF$, and even more preferably $1.5*TF<TC<5*TF$. An advantage of this embodiment is that with $1.2*TF<TC$, and even more preferably $1.5*TF<TC$, the logic element will have a relatively long way still to the closed position when the piece of tramp material is squeezed a second time. Thereby, the dumping of hydraulic fluid in the second squeeze of the tramp material at the CSS position will be efficient, since the logic element is open to a relatively large degree. Furthermore, it is preferable that $TC<10*TF$, and even more preferably $TC<5*TF$, because if the logic element remains open for an unduly long period of time, the vertical shaft of the crusher may drop to a very low position also with small sized pieces of tramp material, which makes re-start of crushing unduly slow.

According to one embodiment, hydraulic fluid is drained from the second plunger surface via at least a third control pipe to switch the logic element from a closed position to an open position, wherein the cross-sectional area of the third control pipe is at least 10%, for example, at least 15%, of the total hydraulic area of the second plunger surface along the entire length of the third control pipe. According to this embodiment, hydraulic fluid can be drained relatively quickly from the second plunger surface, such that the logic element opens quickly when a piece of tramp material enters the crushing gap. Hence, by removing and/or widening any restrictions in the at least a third control pipe such that the hydraulic fluid can be drained therefrom almost without restriction, or at least at a low restriction, the logic element opens quickly and dumping of hydraulic fluid via the logic element may start before high pressures have built up inside the hydraulic system.

According to one embodiment a pilot control valve is fluidly connected to the at least a third control pipe and initiates drain of hydraulic fluid from the second plunger surface when the hydraulic pressure in the at least a third control pipe exceeds a relief setting of the pilot control valve. Accordingly, hydraulic fluid may be controlled in an accurate manner, with the pilot control valve controlling the action of the logic element, which dumps hydraulic fluid at a higher rate than the pilot control valve.

According to one embodiment, the pilot control valve is a direct acting pressure relief valve. Accordingly, the response time of the pilot control valve is short, resulting in that the logic element is made to open quickly, before a large pressure peak has been formed.

According to one embodiment, the response time of the pilot control valve is less than 5 ms. Accordingly, the pilot control valve opens quickly. Thereby, the maximum height of the hydraulic pressure peaks will be rather low, which reduces the mechanical strains on the gyratory crusher.

According to one embodiment, the method further includes draining hydraulic fluid from the hydraulic fluid space via the pressure relief valve at a rate, which makes the hydraulic pressure in the hydraulic system exceed the relief setting of the pilot control valve maximum three times as a piece of tramp material passes vertically downwards through a crushing gap of the gyratory crusher. Accordingly, the pressure in the hydraulic system exceeds the relief pressure of the pilot control valve maximum three times, and preferably maximum two times, and more preferably only one time, the gyratory crusher system is exposed to very small mechanical stresses, which further prolongs the service life of the crusher system.

According to one embodiment, the capacity for dumping hydraulic fluid via the logic element is at least a factor 10, preferably a factor of 10-100, larger than via the pilot control valve. Accordingly, hydraulic fluid can be dumped quickly, due to the relatively large capacity of dumping hydraulic fluid of the logic element.

According to one embodiment, the method further includes heating the hydraulic fluid in the pressure relief valve. According to another embodiment, the hydraulic fluid is heated to a temperature of 10-50° C., for example, 35-45° C. Accordingly, the hydraulic fluid inside of the pressure relief valve, and in particular the hydraulic fluid present in the at least a third control pipe, is kept at a temperature which keeps the viscosity low, also in occasions of low ambient temperatures. Due to the low viscosity, the hydraulic fluid is drained quickly from the second plunger surface via the at least a third control pipe also at low ambient temperatures, to obtain a quick switching of the logic element from a closed position to an open position.

It is a further object to provide a gyratory crusher hydraulic pressure relief valve, which is more efficient in handling uncrushable objects entering the crushing gap of a gyratory crusher.

This object is achieved by means of a gyratory crusher hydraulic pressure relief valve including a hydraulic fluid vestibule, which is arranged to be fluidly connected to a hydraulic fluid space of a gyratory crusher, a logic element, which is arranged for dumping hydraulic fluid from the hydraulic fluid space and which includes a plunger that has a first plunger surface, which is fluidly connected to the hydraulic fluid in the hydraulic fluid vestibule, and a second plunger surface, which is arranged opposite to the first plunger surface, and at least a first control pipe which is arranged for fluidly connecting the second plunger surface to the hydraulic fluid vestibule, wherein the at least a first control pipe is provided with a first supply orifice which restricts the flow of hydraulic fluid from the vestibule towards the second plunger surface to make the time (TC) it takes for the logic element to switch from an open position to a closed position exceed the time (TF) it takes for a closed side setting position of the crusher to make one full round.

With this gyratory crusher hydraulic pressure relief valve, when an uncrushable object, such as a piece of tramp material, has been squeezed a first time between the inner crushing shell and the outer crushing at the CSS position, the logic element will remain at least partly open when the tramp material is squeezed at the CSS position a second time, after the eccentric of the crusher, and thereby the CSS position, has made a further round. Because the logic element is at least partly open at the second squeeze, the hydraulic fluid may be quickly drained from the hydraulic fluid system at such second squeeze, thereby reducing the mechanical stress on the gyratory crusher.

Moreover, this pressure relief valve works efficiently also in situations when packing of material in the crushing gap happens. Packing may occur, for example, when the material is wet. A packing condition is characterised by a lack of free space between particles in the crushing gap. Such lack of free space hinders further crushing of material and results in a hydraulic pressure peak. However, unlike the situation with tramp material, it is often sufficient, during a condition of packing, to increase the width of the crushing gap at the closed side setting CSS position just slightly to reduce the pressure peak, since that is normally sufficient for relieving the packing condition and making the crusher function normally again. With the present pressure relief valve, a packing condition can be handled quickly and with a relatively small lowering of the crushing head, such that normal crushing may start very quickly after a packing condition.

According to one embodiment, the first supply orifice restricts the flow of hydraulic fluid from the vestibule towards the second plunger surface to make the time (TC) it takes for the logic element to switch from an open position to a closed position becomes at least 1.2, for example, at least 1.5, times larger than the time (TF) it takes for a closed side setting (CSS) position of the crusher to make one full round. Accordingly, the logic element will be open to a significant degree when uncrushable material is squeezed a second time.

According to one embodiment, the first supply orifice restricts the flow of hydraulic fluid from the vestibule towards the second plunger surface to obtain: $1.5*TF<TC<10*TF$, for example, $1.5*TF<TC<5*TF$. When $TC<10*TF$, more for example, $TC<5*TF$, the logic element will not remain open for an unduly long period of time. This is an advantage when small pieces of tramp material enter the crushing gap. Such small pieces leave the crushing gap relatively quickly, and if the logic element closes in a time shorter than $10*TF$, or shorter than $5*TF$, then active crushing work can be resumed quickly after the tramp material has left the crusher. Also, with small pieces of tramp material, it is not necessary to lower the vertical shaft very much to obtain a wide enough gap for such tramp material to pass through the crushing gap. Also for this reason it is preferable that the time (TC) of closing the logic element is shorter than 10*TF, for example, shorter than 5*TF.

According to one embodiment at least a third control pipe is fluidly connected to the second plunger surface and is arranged to drain hydraulic fluid from the second plunger surface when the logic element is to switch from a closed position to an open position, wherein the cross-sectional area of the third control pipe is at least 10% of the total hydraulic area of the second plunger surface along the entire length of the third control pipe. Accordingly, the hydraulic fluid may flow very quickly away from the second plunger surface, which means that the logic element may open very quickly. Thereby, the maximum peak height of the pressure peaks may be reduced, resulting in reduced mechanical stress on the gyratory crusher. Preferably, the cross-sectional area of the third control pipe is at least 15% of the total hydraulic area of the second plunger surface along the entire length of the third control pipe.

According to one embodiment, the total hydraulic area of the second plunger surface is equal to 100-125% of the total hydraulic area of the first plunger surface. Accordingly, during normal operation, the second and first plunger surfaces will be exposed to forces of similar magnitude, but acting in opposite directions, which means that the plunger will be balanced. Thereby, a resilient element, such as a spring, keeping the plunger in a closed position during normal crusher operation, can be given a rather low pressing force, for example, a pressing force corresponding to a pressure of only 0.1-8 bar. Thereby, the force to be overcome to open the logic element is relatively low, which makes the logic element open faster. According to a further embodiment, the total hydraulic area of the second plunger surface is 100-110% of the total hydraulic area of the first plunger surface.

According to one embodiment, a resilient element, such as a spring, presses the plunger in the direction of the hydraulic fluid vestibule. Accordingly, the plunger of the logic element may be held in a closed position when the pressure acting on the first plunger surface is equal to, or at least almost equal to, the pressure acting on the second plunger surface. Thus, the plunger is kept in the closed position when the gyratory crusher operates in normal crushing mode.

According to one embodiment, the resilient element exerts a force corresponding to a pressure of at least 0.5 bar, for example, a pressure of 1-2 bar, on the plunger, for example on the second plunger surface, when the plunger is held in its closed position. If a force corresponding to a pressure of less than 0.5 bar is exerted on the plunger, there is a risk that the plunger does not close properly, due to friction in the plunger housing, possible impurities in the hydraulic fluid, etc. The force exerted on the plunger, when the plunger is held in its closed position, corresponds to a pressure of less than 4 bar, for example, less than 2 bar. If a force corresponding to a pressure of more than 4 bar is exerted on the plunger when the plunger is in its closed position, the opening of the logic element may be unduly slow in case of a tramp material situation, which increases the mechanical strains on the crusher.

According to one embodiment, the resilient element, such as a spring, presses the plunger in the direction of the hydraulic fluid vestibule with a force corresponding to a pressure which is lower than the lowest operating pressure of the hydraulic system of the crusher system. Accordingly, the logic element will not close unduly fast after having been open. The force exerted by the resilient element on the plunger corresponds to a pressure, which is at least 0.5 bar lower than the lowest operating pressure of the hydraulic system of the crusher system.

A further object is to provide a gyratory crusher system that has a long service life. This is achieved by a gyratory crusher system having a gyratory crusher and a hydraulic system controlling the vertical position of a vertical shaft carrying a crushing head and an inner crushing shell of the gyratory crusher, wherein the gyratory crusher system further includes a gyratory crusher hydraulic pressure relief valve of the type described hereinabove.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

The invention will hereafter be described in more detail and with reference to the appended drawings.

FIG. 4 is a diagram illustrating an example of pressure relief using the pressure relief valve of FIGS. 3*a-b*.

FIG. 5 is a diagram illustrating a comparative example of pressure relief using a prior art pressure relief valve.

DETAILED DESCRIPTION

Figure 1:
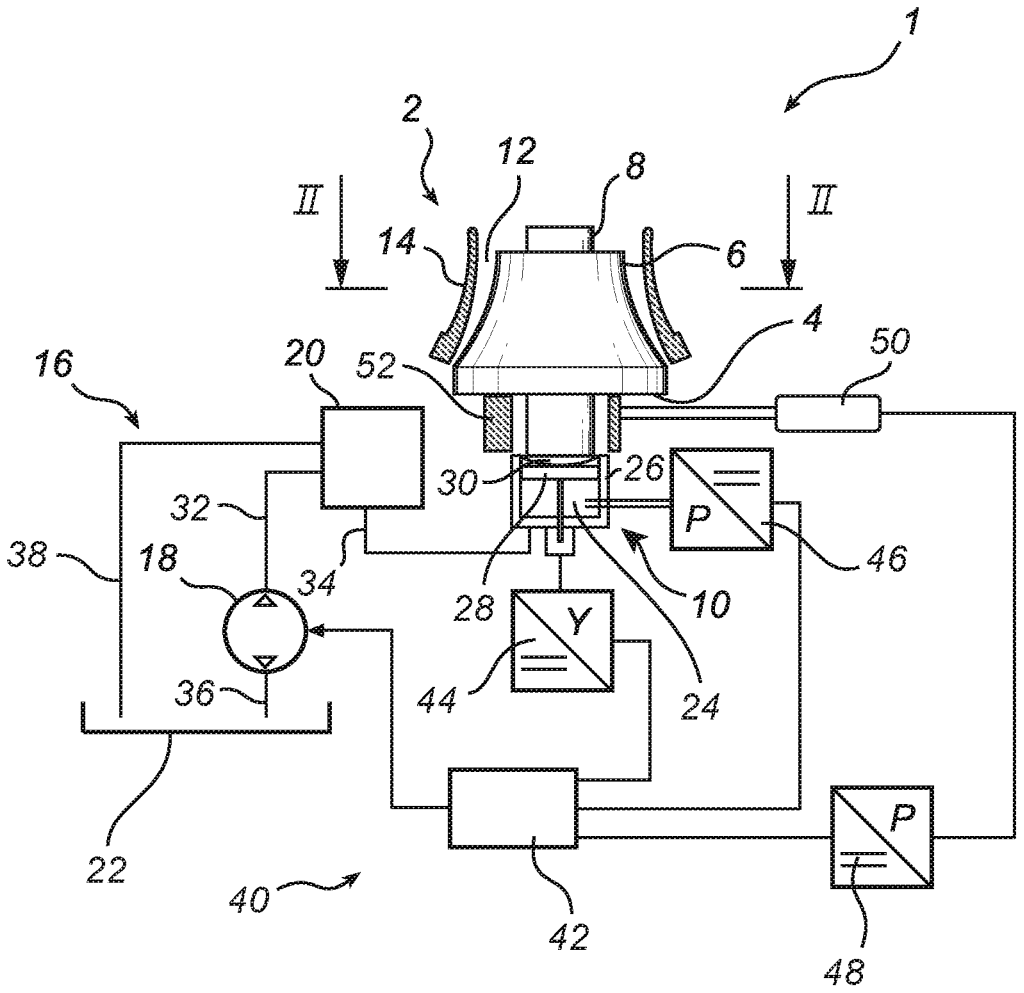
FIG. 1 is a schematic illustration of a crusher system.

FIG. 1 illustrates a crusher system 1. The crusher system 1 includes a gyratory crusher 2 that has a crushing head 4, which supports a first crushing surface formed on an inner crushing shell 6 and which is fixed to a vertical shaft 8. The crushing head 4, being fixed to the vertical shaft 8, is movable in the vertical direction by means of a hydraulic cylinder 10 connected to the lower part of the shaft 8. The hydraulic cylinder 10 makes it possible to adjust the width of a crushing gap 12 formed between the inner crushing shell 6 and a second crushing surface formed on an outer crushing shell 14, which is mounted in a support, not shown for reasons of maintaining clarity of illustration, and which surrounds the inner crushing shell 6.

The crusher system 1 further includes a hydraulic system 16. The hydraulic system 16 has, as its main components, a hydraulic pump 18, which is operative for pumping hydraulic fluid to or from the hydraulic cylinder 10, a pressure relief valve 20, which is arranged for controlling the pressure in the hydraulic system 16, and a hydraulic fluid tank 22.

The hydraulic pump 18 is fluidly connected to a hydraulic fluid space 24 of the hydraulic cylinder 10. The hydraulic fluid space 24 is formed between a cylinder portion 26 and a piston portion 28 of the hydraulic cylinder 10. An axial bearing 30, on which the vertical shaft 8 is supported, rests on the piston portion 28. By varying the amount of hydraulic fluid in the hydraulic fluid space 24, the vertical position of the vertical shaft 8 can be adjusted, and thereby the width of the gap 12 formed between the inner and outer crushing shells 6, 14 may be adjusted. Hydraulic supply pipe 32 and hydraulic cylinder pipe 34 fluidly connect the hydraulic pump 18 to the hydraulic fluid space 24 via the pressure relief valve 20. According to an alternative embodiment, the hydraulic supply pipe 32 may be connected directly to the hydraulic fluid space 24. A tank pipe 36 connects the pump 18 to the tank 22.

The hydraulic fluid tank 22 serves as a pump sump for the pump 18, and the pump 18 pumps, via pipes 36, 32, 34 hydraulic fluid, such as hydraulic oil, from the tank 22 to the hydraulic fluid space 24 when the width of the gap 12 is to be reduced, and pumps hydraulic fluid from the hydraulic space 24 to the tank 22 when the width of the gap 12 is to be increased. It should be appreciated that the pipes 32, 34, 36 may have the form of steel pipes, hydraulic hoses, or any other type of devices that are suitable for conveying pressurized hydraulic fluid.

The pressure relief valve 20 is fluidly connected to the hydraulic fluid space 24 via the hydraulic cylinder pipe 34. The pressure relief valve 20 is arranged for relieving hydraulic pressure, when the hydraulic pressure in the hydraulic system 16 exceeds a certain pressure, by dumping hydraulic fluid to the tank 22 via a dump pipe 38, as will be described in more detail hereinafter.

The crusher system 1 further includes a control system 40. The control system 40 has a control device 42, which is operative for receiving various signals indicating the function of the gyratory crusher 2. Thus, the control device 42 is operative for receiving a signal from a position sensor 44 which indicates the present vertical position of the vertical shaft 8. From this signal the width of the gap 12 can be estimated. Furthermore, the control device 42 is operative for receiving a signal from a pressure sensor 46, indicating the hydraulic pressure in the hydraulic cylinder 10. Based on the signal from the pressure sensor 46 the control device 42 can calculate the actual mean operating pressure and the peak pressure of the gyratory crusher 2.

The control device 42 may also receive a signal from a power sensor 48, which is operative for measuring the power supplied to the gyratory crusher 2 from a motor 50, which is operative for making the vertical shaft 8 gyrate in a per se known manner. The gyratory movement of the vertical shaft 8 is accomplished by the motor 50 driving an eccentric 52, which is arranged around the vertical shaft 8 in a per se known manner, and which is schematically illustrated in FIG. 1. The power sensor 48 may also send a signal to the control device 42 indicating the number of rounds per second (in the unit 1/s or Hz) of the eccentric 52.

The control device 42 is operative for controlling the operation of the pump 18, for example in an on/off manner, or in a proportional manner, such that the pump 18 supplies an amount of hydraulic fluid to the hydraulic cylinder 10 that generates a desired vertical position of the vertical shaft 8, and a desired width of the gap 12.

Figure 2:
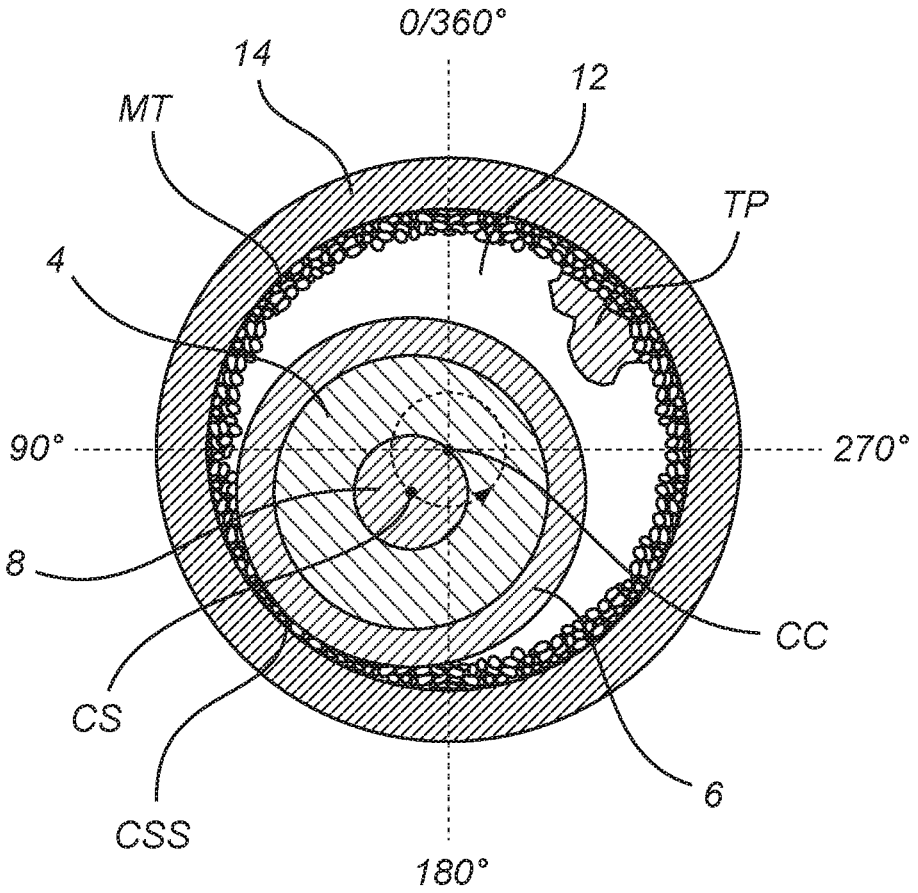
FIG. 2 is a schematic illustration of a crushing gap, as seen in the direction of the arrows II-II of FIG. 1.

FIG. 2 illustrates the crushing gap 12, as seen in the direction of the arrows II-II of FIG. 1, i.e., as seen from the top of the gyratory crusher. In the perspective of FIG. 2 it is clear how the inner crushing shell 6, mounted on the crushing head 4, executes a gyrating movement inside the outer crushing shell 14 as an effect of the action of the eccentric 52 described hereinbefore with reference to FIG. 1. Hence, the centre line CS of the vertical shaft 8, on which the crushing head 4 is mounted, will be displaced from the centre line CC of the crusher. The circular dashed line of FIG. 2 illustrates the path along which the centre line CS of the vertical shaft 8 moves around the centre line CC of the crusher.

The position at which the crushing gap 12 has, at a certain moment, the lowest width is called the closed side setting (CSS) position. In the instance illustrated in FIG. 2, the CSS position is located, in the 360° co-ordinate system of FIG. 2, at about 135°. Material (MT) to be crushed is present in the crushing gap 12, and the majority of the crushing work in the crushing gap 12 occurs at the CSS position. As an effect of the gyrating movement of the inner crushing shell 6 the position of the CSS will rotate in the crushing gap 12 at a number of revolutions which is equal to that of the eccentric 52 illustrated in FIG. 1. Typically, the number of revolutions of the eccentric 52, and, consequently, of the CSS, is 3-8 rounds per second (equal to 180 to 480 rounds per minute).

In the situation illustrated in FIG. 2, a piece of uncrushable tramp material TP, such as a digging tooth from an excavator, has unintentionally entered the crushing gap 12. The uncrushable tramp material TP is located in the position 315° in the crushing gap 12. When the CSS has moved a further 180°, i.e. after half a revolution of the eccentric 52, the CSS will coincide with the tramp material TP. If the width of the CSS is smaller than the size of the tramp material TP, for example if the width of the CSS is 15 mm and the tramp material has a size of 50 mm, the inner crushing shell 6, the crushing head 4, and the vertical shaft 8 will be exposed to high mechanical forces when the tramp material is "squeezed" at the CSS position. These forces will, due to the cone shape of the inner crushing shell 6, propagate through the vertical shaft 8, and the axial bearing 30 and the piston portion 28 illustrated in FIG. 1 and further to the hydraulic fluid space 24 where the hydraulic pressure increases rapidly to generate a hydraulic pressure peak. As the CSS passes by the tramp material TP the pressure will again be reduced, until the next time the CSS position coincides with the tramp material TP and "squeezes" the tramp material TP a second time.

Figure 3A:
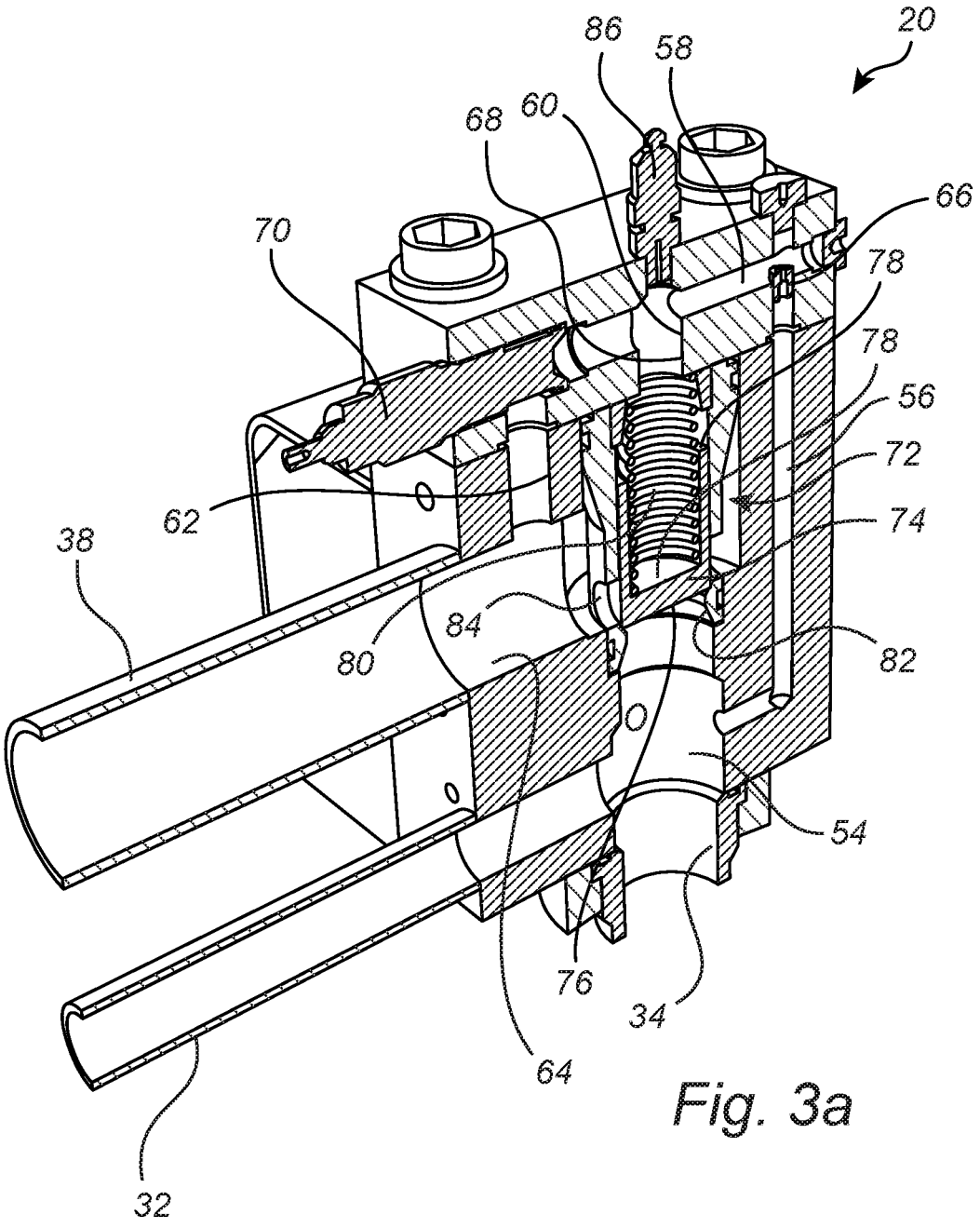
FIG. 3*a* is schematic illustration of a pressure relief valve, as seen in cross-section, with a logic element in closed position.

FIG. 3*a* is a schematic illustration of the pressure relief valve 20, as seen in cross-section. The pressure relief valve 20 includes a hydraulic fluid vestibule 54, a first control pipe 56, a second control pipe 58, a third control pipe 60, a fourth control pipe 62, a pressure relief pipe 64, a first supply orifice 66, a second supply orifice 68, a pilot control valve 70, and a logic element 72. The logic element 72 is sometimes referred to as a "dump valve" as it has the function of opening to dump hydraulic fluid from the hydraulic fluid space 24.

The hydraulic fluid vestibule 54 is fluidly connected to the hydraulic supply pipe 32 and the hydraulic cylinder pipe 34. During normal operation of the gyratory crusher 2 the pump 18, illustrated in FIG. 1, pumps hydraulic fluid to or from the hydraulic fluid space 24 via the supply pipe 32, the vestibule 54 and the hydraulic cylinder pipe 34.

The first control pipe 56 is at one end fluidly connected to the hydraulic fluid vestibule 54 and is at the other end fluidly connected to a first end of the second control pipe 58. The first supply orifice 66 is arranged in the transition between the first and second control pipes 56, 58.

The second control pipe 58 is at a central portion thereof fluidly connected to a first end of the third control pipe 60, and is at a second end thereof fluidly connected to a first end of the fourth control pipe 62. The second supply orifice 68 is optional, and may be arranged in the transition between the second and third control pipes 58, 60. The pilot control valve 70 is arranged in the transition between the second and fourth control pipes 58, 62 for sensing the hydraulic pressure and for opening if the hydraulic pressure exceeds a relief setting of the pilot control valve 70. If the gyratory crusher 2 is arranged for operating at hydraulic pressures of, for example, 4-5 MPa, the pilot control valve 70 may have a relief setting of 7 MPa. Preferably, the pilot control valve 70 is of the type: direct acting pressure relief valve. A direct acting pressure relief valve has no internal pilot valves, which means that it normally has a short response time. For example, the response time of the pilot control valve 70 is less than 5 ms.

The fourth control pipe 62 is at a second end thereof fluidly connected to a central portion of the pressure relief pipe 64. The pressure relief pipe 64 is at a first end thereof fluidly connected to the side of the logic element 72, and is at a second end thereof fluidly connected to the dump pipe 38.

The logic element 72 includes a plunger 74, which has a first plunger surface 76, which is in fluid contact with the hydraulic fluid in the hydraulic fluid vestibule 54, and a second plunger surface 78, which is arranged opposite to the first plunger surface 76, and which is fluidly connected to a second end of the third control pipe 60. A "hydraulic area" is that area on which a pressurized hydraulic fluid exerts its pressure. The total hydraulic area of the second plunger surface 78 is preferably equal to 100-125% of the total hydraulic area of the first plunger surface 76, still more preferably the total hydraulic area of the second plunger surface 78 is 100 to 110% of the total hydraulic area of the first plunger surface 76, or the plunger surfaces 76, 78 have substantially equal hydraulic areas. Hence, when the pressure in the vestibule 54 is equal to the pressure in the third control pipe 60 the plunger 74 is in hydraulic balance.

Figure 3B:
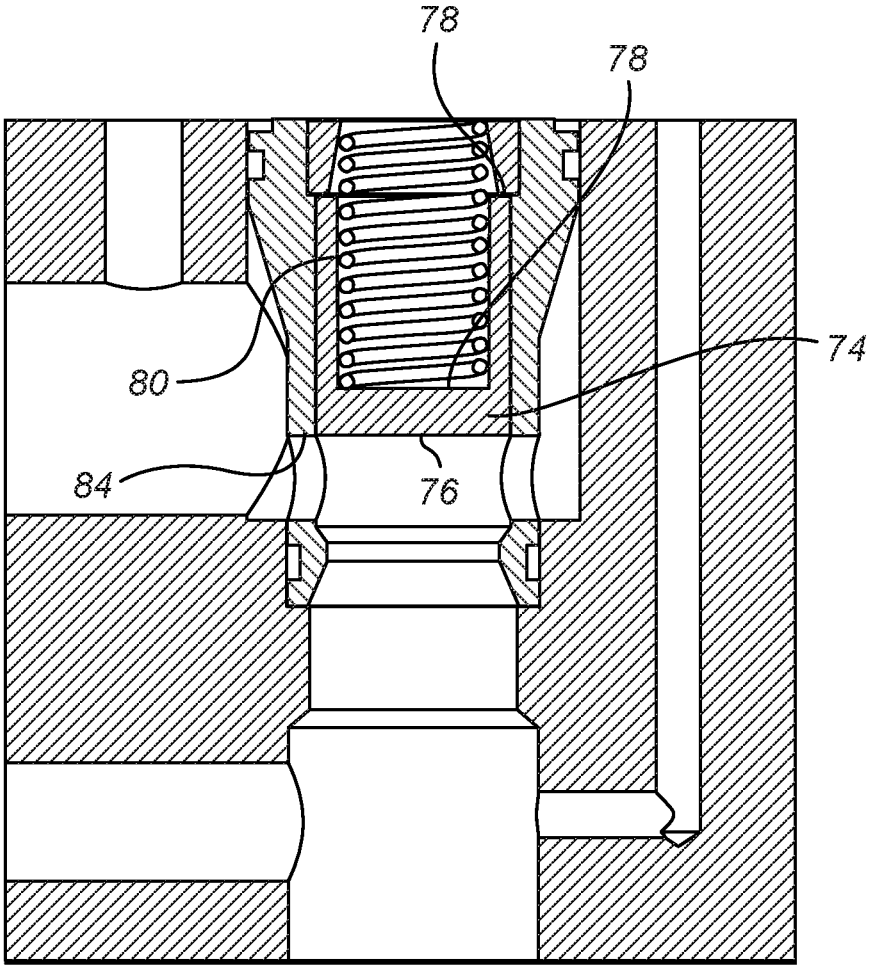
FIG. 3*b* illustrates the logic element of FIG. 3*a* in open position.

A spring 80 is arranged to press the plunger 74 in the direction of the vestibule 54. The spring 80 may, for example, act on the second plunger surface 78. The logic element 72 further includes a seat 82, against which the plunger 74 rests in its closed position, illustrated in FIG. 3*a*, and a drain opening 84, through which hydraulic fluid may be dumped when the plunger 74 is in its open position, which is illustrated in FIG. 3*b*. In accordance with one example, the spring 80 exhibits a force corresponding to at least 0.5 bar, for example, 1-2 bar, or less than 4 bar, on the plunger 74 when the plunger 74 is in the closed position.

The function of the pressure relief valve 20 will now be described with reference to an example. During normal operation of the gyratory crusher 2 the plunger 74 is in its closed position, as illustrated in FIG. 3*a*. The pump 18, illustrated in FIG. 1, pumps hydraulic fluid to or from the hydraulic fluid space 24 to obtain a desired width of the crushing gap 12. The width of the crushing gap 12 may be estimated from the vertical position of the vertical shaft 8, as measured by the position sensor 44. The hydraulic pressure may, during such normal operation, vary in the range of, for example, 3-6 MPa.

When a piece of tramp material TP enters the crushing gap 12, it results in the situation illustrated in FIG. 2. When the CSS has rotated 180° compared to the illustration of FIG. 2, the tramp material TP coincides with the CSS and is "squeezed" between the inner and outer crushing shells 6, 14 and causes a hydraulic pressure peak. Thereby, the pressure in the hydraulic fluid space 24, the hydraulic cylinder pipe 34, and the vestibule 54 rapidly increases to, for example, 9 MPa. The increased hydraulic pressure in the vestibule 54 propagates to the first control pipe 56 and further, via the first supply orifice 66 and the second control pipe 58, to the pilot control valve 70. Since the pilot control valve 70 is exposed to a hydraulic pressure which exceeds the relief setting of 7 MPa, the pilot control valve 70 will open and will release hydraulic fluid via the fourth control pipe 62 to the pressure relief pipe 64 and further, via the dump pipe 38, to the tank 22.

The opening of the pilot control valve 70 causes a reduction in the pressure in the second and third control pipes 58, 60, a reduction which is not quickly neutralized, since the flow of hydraulic fluid to the second and third control pipes 58, 60 is restricted by the first supply orifice 66. Thereby, the pressure acting, via the third control pipe 60, on the second plunger surface 78 becomes lower than the pressure acting, via the vestibule 54, on the first plunger surface 76. This causes the plunger 74 to move upwards from its closed position illustrated in FIG. 3*a* to its open position illustrated in FIG. 3*b*, such that a connection between the vestibule 54 and the tank 22 is opened, via the drain opening 84, the pressure relief pipe 64 and the dump pipe 38. The opening of the plunger 74 provides for a fast dumping of hydraulic fluid from the hydraulic fluid space 24 to relieve the mechanical strain caused by the uncrushable tramp material TP. The pilot control valve 70 contributes to the dumping of hydraulic fluid, but the main purpose of the pilot control valve 70 is to reduce the hydraulic pressure at the second plunger surface 78 to cause an opening of the logic element 72, since, typically, the capacity for dumping hydraulic fluid via the logic element 72 is typically at least a factor ten, often a factor of 10-100, larger than via the pilot control valve 70.

In FIG. 3*b* the plunger 74 is illustrated in a completely open position, i.e., a 100% open position. However, when the uncrushable tramp material TP that enters the crushing gap 12, as illustrated in FIG. 2, is of moderate size a hydraulic pressure peak caused by a "squeezing" of such moderately sized tramp material TP between the inner and outer crushing shells 6, 14 may result in only a partial opening of the plunger 74, which may in such case be sufficient to handle the pressure peak.

Furthermore, in a case where the logic element 72 is of a relatively large size in relation to the size of the gyratory crusher 2 to which the logic element 72 is connected, also an uncrushable tramp material TP of a large size may result in only a partial opening of the plunger 74. Hence, the expression "open position" with regard to the plunger 74 means that the plunger 74 is at least partially open. The expression "closed position" with regard to the plunger 74 means, on the other hand, that there is no significant flow of hydraulic fluid through the logic element 72. The time (TC) it takes for the plunger 74 of the logic element 72 to switch from an open position to a closed position exceeds, for at least some degrees of opening of the plunger 74, the time (TF) it takes for a closed side setting (CSS) position of the gyratory crusher to make one full round. For example, the time (TC) may exceed the time (TF) as long as the degree of opening of the plunger 74 is 25-100%, with an opening degree of 25% meaning that the plunger 74 has opened to a degree corresponding to 25% of its full stroke, wherein 100% means that the plunger 74 has opened to its full stroke, as it is illustrated in FIG. 3*b*. For example, if the stroke at 100% opening of the plunger 74 is 16 mm, then an opening degree of 25% would mean that the plunger 74 has opened 0.25*16 mm=4 mm.

Preferably, the logic element 72 opens quickly after the pilot control valve 70 has opened. To obtain such, the second supply orifice 68 preferably has an open cross-sectional area which is at least 10% of the total hydraulic area of the second plunger surface 78, such that hydraulic fluid may be rapidly drained from the third control pipe 60 and further out of the second and fourth control pipes 58, 62 to cause a rapid pressure reduction at the second plunger surface 78 which causes an opening of the plunger 74. Hence, for example, if the hydraulic area of the second plunger surface 78 is 1250 $mm^2$, then the second supply orifice 68 should have an open cross-sectional area of at least 1250*0.10=125 $mm^2$, meaning, in the case of circular second supply orifice 68, a circular opening with a diameter of at least about 12.5 mm Thus, the hydraulic fluid is not exposed to a cross-section that is more narrow than 10% of the total hydraulic area of the second plunger surface 78 when being forwarded from the third control pipe 60 and out to the pressure relief pipe 64. Additionally, the cross-section of the other portions of the second and fourth control pipes 58, 62 via which the hydraulic fluid is to be drained should preferably have an open area of at least 15% of the total hydraulic area of the second plunger surface 78 along the entire length thereof, to enable quick forwarding of the hydraulic fluid out of the third control pipe 60 and further to the pressure relief pipe 64 to enable a quick opening of the plunger 74 of the logic element 72. According to one embodiment, the relief valve 20 has no second supply orifice 68 to even further improve the rate at which hydraulic fluid may be drained from the third control pipe 60.

When the CSS position has passed the tramp material TP, the hydraulic pressure will again decrease to below the relief setting of the pilot control valve 70. The reduced pressure causes the pilot control valve 70 to close. When the pilot control valve 70 has closed, the spring 80 forces the plunger 74 towards its closed position. However, as the plunger 74 moves towards its closed position, i.e., downwards as illustrated in FIG. 3*a*, under the force of the spring 80 the volume available for hydraulic fluid inside the plunger 74 increases. Such hydraulic fluid is supplied to the interior of the plunger 74 and the third control pipe 60 from the vestibule 54 via the first and second control pipes 56, 58, and the first supply orifice 66 functions as a "brake" allowing only a slow flow of hydraulic fluid therethrough and causing an underpressure in the second and third control pipes 58, 60 that hampers the closing movement of the plunger 74. Thus, the first supply orifice 66 reduces the speed at which the plunger 74 can close by choking the supply of hydraulic fluid to the interior of the plunger 74.

The open area of the first supply orifice 66 is set to such a size that the time (TC) it takes for the plunger 74 to close, i.e. to go from an open position to a closed position, is longer than the time it takes for the CSS position to make a full turn. By "open position" is, as discussed hereinabove, meant a position in which the drain opening 84 is at least partially open, such that hydraulic fluid can flow from the vestibule 54 via said drain opening 84 and further to the dump pipe 38. By "a closed position" is meant a position in which no hydraulic fluid can pass through the drain opening 84. Hence, for example, in a gyratory crusher 2 in which the eccentric 52 is rotated at 5 rounds per second, meaning that the CSS position is also rotated at 5 rounds per second, the time (TF) for the CSS position to make one full turn is 1/5=0.2 seconds. In such a crusher the time (TC) should be longer than 0.2 seconds, i.e. TC>TF, such that the plunger 74 of the logic element 72, after opening caused by a first pressure peak resulting from the first contact of the CSS position with the tramp material TP, does not fully close before the CSS position makes a further contact, after having made a further turn, with that same tramp material TP. Thereby, the logic element 72 is already partly open when the CSS position makes its further contact with the tramp material TP, and dumping of hydraulic fluid via the logic element 72 and the dump pipe 38 may start very quickly, since the plunger 74 is already partly open. Thereby, the mechanical stress on the hydraulic system caused by repeated contacts with the tramp material TP is substantially reduced.

Furthermore, since the logic element 72 remains open for a relatively long period of time, the amount of hydraulic fluid that is emptied from the hydraulic fluid space 24 is relatively large, which means that the vertical shaft 8 with the crushing head 4 and inner crushing shell 6 mounted thereon is lowered relatively much each time the squeezing of the tramp material TP at the CSS position causes a dumping of hydraulic fluid via the logic element 72. Thereby, the tramp material TP moves downwards in the gap 12 relatively quickly, meaning that the number of times that the CSS position contacts the tramp material TP before the tramp material TP ultimately leaves the gap 12 and is discharged from the crusher 2 is reduced. Typically, the CSS position would contact the tramp material TP only 3 to 7 times before the tramp material is discharged from the gap 12.

As noted above, the time (TC) it takes for the logic element 72 to switch from an open position to a closed position is longer than the time (TF) it takes for the CSS position to make a full round, i.e. TC>TF. For example, TC>1.2*TF, or 1.5*TF<TC<10*TF. Hence, if the time (TF) it takes for the CSS position to make a full round, which time is equal to the time for the eccentric 52 to make a full round, is for example 0.2 seconds, then the time (TC) it takes for the plunger 74 to switch from an open position to a closed position should in such a case preferably be 0.3 to 1.0 seconds.

Preferably, the spring 80 presses the plunger 74 in the direction of the hydraulic fluid vestibule 54 with a force corresponding to a pressure, which is lower than the lowest operating pressure of the hydraulic system 16 of the crusher system 1. In this respect "operating pressure" relates to a hydraulic pressure in the hydraulic system 16, illustrated in FIG. 1, when the gyratory crusher 2 is active with crushing material. An advantage of this embodiment is that the logic element 72 will not close unduly fast after having been open. For example, an unduly high pressing force of the spring 80 could result in cavitation in the third control pipe 60, resulting in a faster than desired closing of the logic element 72. The force exerted by the spring 80 on the plunger 74 can correspond to a pressure that is at least 0.5 bar lower than the lowest operating pressure of the hydraulic system 16 of the crusher system 1.

The relief valve 20 is provided with a heater 86, illustrated schematically in FIG. 3*a* as a combined degassing nipple and heater, for heating the hydraulic fluid present in the relief valve 20. The heater 86 may, for example, be an electrical heater, a heater circulating a heated liquid, or any other suitable type of heater. The hydraulic fluid in the pressure relief valve 20 can be heated to a temperature of 10-50° C., for example, 35-45° C., during normal operation of the crusher 2, when the hydraulic fluid is almost static inside the control pipes 56, 58, 60, to obtain a low viscosity of the hydraulic fluid, also in occasions of low ambient temperatures. Due to such low viscosity the hydraulic fluid is, when a piece of tramp material TP enters the crushing gap 12, drained quickly from the second plunger surface 78 via the at least a third control pipe 60 also at low ambient temperatures, to obtain a quick switching of the logic element 72 from closed position to open position.

FIG. 4 is a diagram that illustrates an experiment in which a piece of tramp material TP was deliberately thrown into a crushing gap 12 of a gyratory crusher 2, which is arranged in accordance with FIG. 1 and which is provided with a pressure relief valve 20 in accordance with FIGS. 3*a-b*. The pressure relief valve 20 has a first supply orifice 66 with a diameter of 1.5 mm and, hence, an open area of about 1.8 $mm^2$. The spring 80 exhibits a force corresponding to a pressure of 1.2 bar on the plunger 74 when the plunger 74 is in the closed position, and the resulting (TC) is about 2.5 times (TF). The pilot control valve 70 has a relief setting of 6 MPa. The second supply orifice 68 has a diameter of 15 mm and, hence, an open area of about 180 $mm^2$. Thus, the flow of hydraulic fluid is exposed to a considerable throttling at the first supply orifice 66, but may flow with almost no restriction through the second supply orifice 68.

In FIG. 4, the curve HP illustrates the hydraulic pressure in the hydraulic fluid space 24 as measured by pressure sensor 46, and the curve VP illustrates the vertical position of the crushing head 4 and the inner crushing shell 6, as measured by the position sensor 44. During normal operation, the crusher 2 operates at a hydraulic pressure of about 3.5 to 6 MPa, and a relative vertical position of the shaft 8 of 62 mm. The tramp material TP enters the gap 12 at the time TTP, and shortly thereafter, at time T1, the CSS position coincides with the tramp material TP and a first pressure peak occurs. Due to the fast response of the pressure relief valve 20, the dumping of hydraulic fluid starts quickly, and the hydraulic pressure P peaks at about 9.3 MPa, and is then rapidly reduced to about 1 MPa. The plunger 74 of the logic element 72 remains open after the first pressure peak, and is still open at time T2 when the CSS position coincides with the tramp material TP a second time. Thereby, the second pressure peak rises to only about 5 MPa, since dumping of hydraulic fluid commences immediately, due to the logic element 72 still being open.

Simultaneously with the hydraulic fluid being dumped from the hydraulic fluid space 24, the crushing head 4 with the inner crushing shell 6 is lowered, first to about 55 mm after the first pressure peak, then further down to 52 mm after the second pressure peak. This increases the width of the gap 12 such that the tramp material TP may travel faster vertically downwards through the gap 12. Further, and still lower pressure peaks occur at T3, T4, T5 and T6, and at TOUT the tramp material TP leaves the crushing gap 12. Only one of the pressure peaks, namely the first one, exceeds that pressure which is the relief setting of the pilot control valve 70.

FIG. 5 illustrates a comparative example of operating a gyratory crusher with a pressure relief valve of the prior art. The prior art pressure relief valve has a first supply orifice with a diameter of 2.5 mm and, hence, an open area of about 5 $mm^2$, a spring exhibits a force corresponding to a pressure of 2.0 bar on the plunger when the plunger is in the closed position, and the resulting (TC) is about 0.1 times (TF). The pilot control valve has a relief setting of 7 MPa. The second supply orifice has a diameter of 3 mm and, hence, an open area of about 7 $mm^2$.

In FIG. 5, the curve HP illustrates the hydraulic pressure in the hydraulic fluid space, and the curve VP illustrates the vertical position of the crushing head and the crushing shell. The tramp material TP enters the crushing gap at the time (TTP), and shortly thereafter, at time T1, the CSS position coincides with the tramp material TP and a first pressure peak occurs. The hydraulic pressure peaks at a pressure P of about 9 MPa, before the pressure relief valve opens. The plunger of the pressure relief valve closes quickly, which means that only a small amount of hydraulic fluid is dumped. At time T2 the CSS position coincides with the tramp material TP a second time, and the hydraulic pressure increases to about 15 MPa, since the tramp material has travelled somewhat longer down the gap 12. Simultaneously with the hydraulic fluid being dumped from the hydraulic fluid space the crushing head with the inner crushing shell is lowered, but only about 2 mm for each pressure peak. This increases the width of the gap very slowly, such that the tramp material TP travels slowly downwards through the crushing gap. Hence, in total 23 pressure peaks occur before the tramp material leaves the crushing gap at $T_{OUT}$. Of these 23 pressure peaks as many as 17 pressure peaks exceed that pressure which is the relief setting of the pilot control valve.

Comparing the results of FIG. 4, using the pressure relief valve of FIGS. 3*a-b*, to those of FIG. 5, using the prior art pressure relief valve, it becomes clear that using the pressure relief valve 20 of FIGS. 3*a-b* provides for fewer pressure peaks, and pressure peaks of lower magnitude, compared to using the pressure relief valve of the prior art. Thereby, the mechanical stress on the hydraulic system 16 is considerably reduced using the pressure relief valve 20, compared to that of the prior art.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A gyratory crusher hydraulic pressure relief valve comprising:

a hydraulic fluid vestibule arranged to be fluidly connected to a hydraulic fluid space of a gyratory crusher; and a logic element arranged for dumping hydraulic fluid from the hydraulic fluid space, the logic element including a plunger having a first plunger surface fluidly connected to the hydraulic fluid in the hydraulic fluid vestibule, and a second plunger surface arranged opposite the first plunger surface, and at least one first control pipe arranged for fluidly connecting the second plunger surface to the hydraulic fluid vestibule, wherein the at least one first control pipe is provided with a first supply orifice which restricts the flow of hydraulic fluid from the vestibule towards the second plunger surface to make a time (TC) it takes for the logic element to switch from an open position to a closed position exceed a time (TF) it takes for a closed side setting position of the crusher to make one full round.

2. The relief valve according to claim 1, wherein the first supply orifice restricts the flow of hydraulic fluid from the vestibule towards the second plunger surface to make the time (TC) it takes for the logic element to switch from the open position to the closed position to become at least 1.2 times larger than the time (TF) it takes for the closed side setting position of the crusher to make one full round.

3. The relief valve according to claim 2, wherein the first supply orifice restricts the flow of hydraulic fluid from the vestibule towards the second plunger surface to obtain: $1.5*TF<TC<10*TF$.

4. The relief valve according to claim 1, wherein at least one additional control pipe is fluidly connected to the second plunger surface and is arranged to drain hydraulic fluid from the second plunger surface when the logic element is to switch from a closed position to an open position, wherein the cross-sectional area of the at least one additional control pipe is at least 10% of the total hydraulic area of the second plunger surface along the entire length of the at least one additional control pipe.

5. The relief valve according to claim 4, wherein a pilot control valve is fluidly connected to the at least one at least one additional control pipe and is arranged to initiate draining of hydraulic fluid from the second plunger surface when the hydraulic pressure in the at least one at least one additional control pipe exceeds a relief setting of the pilot control valve, wherein the pilot control valve is a direct acting pressure relief valve.

6. The relief valve according to claim 4, wherein the cross-sectional area of the at least one at least one additional control pipe is at least 15%.

7. The relief valve according to claim 1, wherein the relief valve is provided with a heater for heating the hydraulic fluid.

8. The relief valve according to claim 1, wherein the total hydraulic area of the second plunger surface is equal to 100-125%, of the total hydraulic area of the first plunger surface.

9. The relief valve according to claim 1, wherein a spring presses the plunger in the direction of the hydraulic fluid vestibule with a force, when the plunger is in its closed position, corresponding to a pressure of the group of at least 0.5 bar, of less than 4 bar, and 1-2 bar.

10. The relief valve according to claim 1, wherein the total hydraulic area of the second plunger surface is equal to 100-110% of the total hydraulic area of the first plunger surface.

* * * * *